United States Patent [19]

Howell

[11] Patent Number: 4,714,210

[45] Date of Patent: Dec. 22, 1987

[54] DISPENSING APPARATUS

[75] Inventor: Gary W. Howell, Newark, Del.

[73] Assignee: E. I. Du Pont de Nemours and Company, Wilmington, Del.

[21] Appl. No.: 877,616

[22] Filed: Jun. 23, 1986

[51] Int. Cl.[4] ..... B65H 16/02; B65H 23/08

[52] U.S. Cl. ..... 242/55.3; 242/683; 242/75.4

[58] Field of Search ..... 242/55.3, 194, 55, 75.4, 242/68.3, 58

[56] References Cited

U.S. PATENT DOCUMENTS

| | | | |
|---|---|---|---|
| 1,713,277 | 5/1929 | Goldberg et al. | 242/68.3 |
| 2,213,777 | 9/1940 | Wittel | 242/68.3 |
| 2,924,493 | 2/1955 | Preble | 312/39 |
| 3,229,926 | 5/1964 | Weber | 242/55.3 |
| 3,281,089 | 10/1966 | Krueger et al. | 242/55.3 |
| 3,552,684 | 1/1971 | Pineda | 242/68.3 X |
| 3,589,634 | 6/1971 | Mason | 242/71.8 |
| 3,677,494 | 7/1972 | Protas | 242/194 |
| 3,690,528 | 9/1972 | O'Connor | 225/37 |
| 3,870,211 | 3/1975 | Schriever | 225/34 |
| 3,877,656 | 4/1975 | Suzaki | 242/68.3 |
| 4,351,208 | 9/1982 | Cobleigh et al. | 83/167 |
| 4,351,497 | 9/1982 | Kiessling et al. | 242/194 |
| 4,383,657 | 5/1983 | Suh | 242/55 |
| 4,527,722 | 7/1985 | Strachan | 242/55.3 X |

FOREIGN PATENT DOCUMENTS

| | | |
|---|---|---|
| 0081328 | 11/1982 | European Pat. Off. . |
| 2065070 | 12/1979 | United Kingdom . |
| 2121001 | 5/1982 | United Kingdom . |
| 2153789 | 8/1985 | United Kingdom . |

*Primary Examiner*—Stuart S. Levy
*Assistant Examiner*—Katherine Matecki

[57] ABSTRACT

A dispensing apparatus for dispensing two strip materials, each carried on a separate spool, includes a hub having a slot therein which exposes a portion of one but not the other of the spools. A friction producing member is extensible through the slot and into friction generating engagement with the selected one of the spools to exert a drag force on one of the spools to the exclusion of the other. The friction producing member is received in a groove formed in a spindle so that torque imposed on the member by rotation of the spool is transmitted to the spindle.

5 Claims, 3 Drawing Figures

DISPENSING APPARATUS

BACKGROUND OF THE INVENTION

1. Field of the Invention

The present invention relates to a dispensing apparatus for dispensing two strips of a plastic material, such as a tape, with a differential friction load being imposed on one of the two strips.

2. Description of the Prior Art

The chemical analysis instrument disclosed and claimed in the copending application Ser. No. 642,814, filed Aug. 21, 1984 and assigned to the assignee of the present invention utilizes a pair of ribbon-like strips of plastic material to form chemical analysis cuvettes. The strips are arranged in radially superimposed fashion on a rotating cuvette-forming wheel. The strips are drawn onto the cuvette-forming wheel as the wheel is rotationally advanced.

The inner of the strips is deformed by a jet of heated air into intimate contact with a cuvette molding recess disposed on the periphery of the wheel. The outer strip is tightly stretched in a chordal fashion over the deformed portion of the inner strip. When heat sealed about the contours of the molding recess an analysis cuvette is formed on-site in a cost effective manner.

It is believed to be advantageous to provide a dispensing apparatus for holding the supply spools for both the inner and the outer strip of plastic material used to form the cuvettes. In addition, since the outer strip must be tightly drawn across the edges of the mold recess which receives the inner strip it is important that the dispensing apparatus be adapted to apply a differential friction load on the spool of the outer strip in order to retard the dispensation of that strip with respect to that of the inner strip and thereby to permit the formation of the required chordal relationship for the outer strip.

SUMMARY OF THE INVENTION

In accordance with the present invention provided is a film dispensing apparatus for dispensing two strips of plastic film material, each of which is mounted on a separate spool. The dispensing apparatus includes a cannister mountable to a spindle. The cannister is provided with a central hub which receives the spools such that one of the spools is permitted to free-wheel, that is freely rotate about its axis, while the second of the spools is inhibited in its freedom of rotation by a rotation retarding member. In the preferred case the rotation retarding member is received within a groove provided in the spindle and takes the form of a clip having a friction producing surface thereon. The friction producing surface protrudes through an appropriately positioned slot disposed in the hub of the cannister to allow the surface to bear against the spool carrying the selected one of the strips of film. In this manner a differential drag is imposed on the selected one as opposed to the other of the strips of plastic material. A portion of the clip abuts the sidewalls of the groove so that any torque imposed on the clip due to its interaction with the spool is transmitted into and taken up by the spindle.

BRIEF DESCRIPTION OF THE DRAWINGS

The invention will be more fully understood from the following detailed description thereof taken in connection with the accompanying drawings which form part of this application and in which.

DETAILED DESCRIPTION OF THE INVENTION

Figure 1:
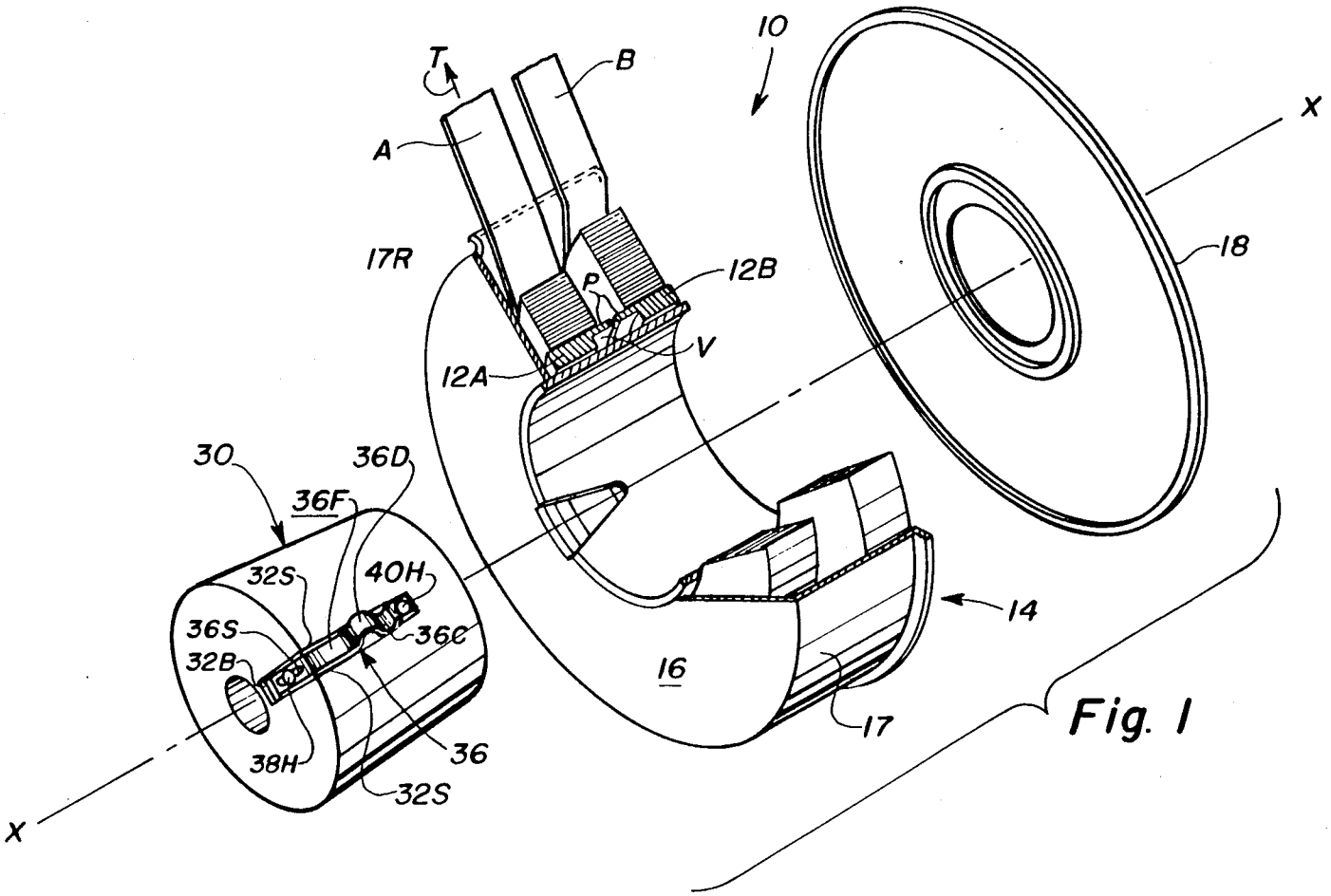
FIG. 1 is an exploded, perspective view of a film dispensing apparatus in accordance with the present invention with portions broken away for clarity and with the spindle rotated one hundred eighty degrees.

Throughout the following detailed description similar reference numerals refer to similar elements in all figures of the drawings.

Figure 2:
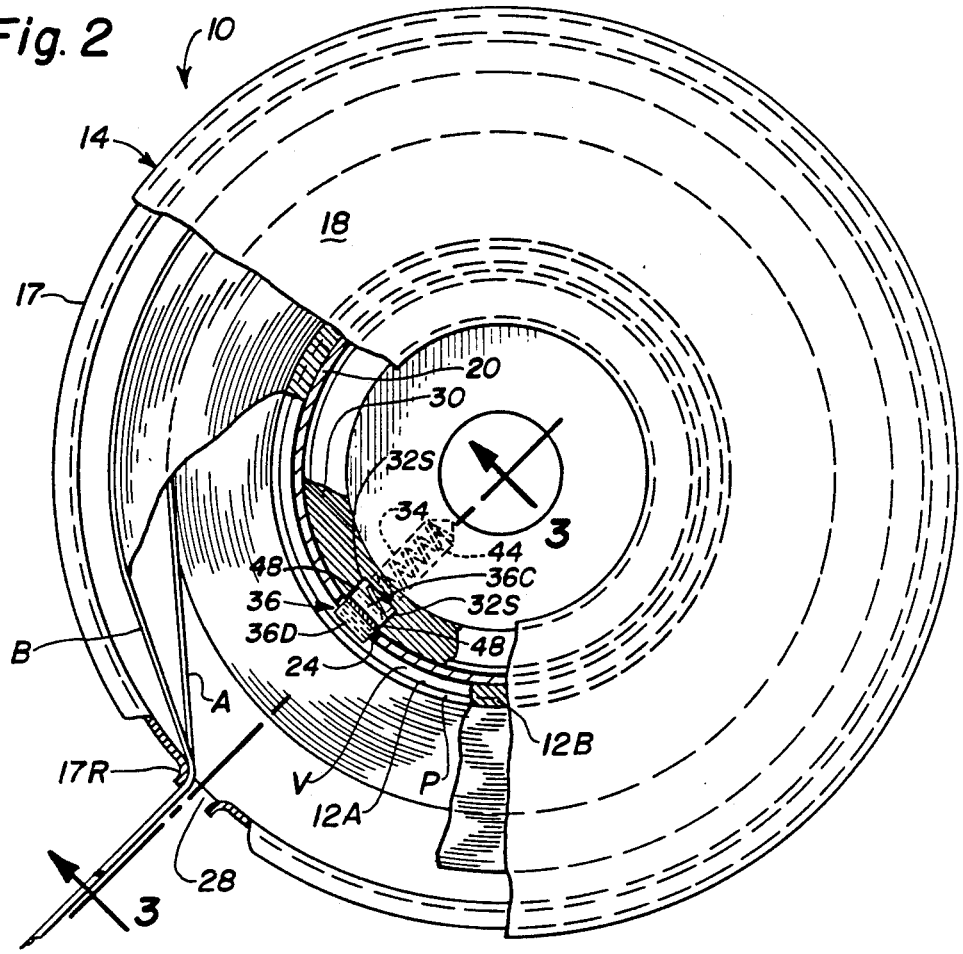
FIG. 2 is an end view of the assembled film dispensing apparatus taken along view lines 2—2 in FIG. 3 with portions broken away for clarity.
Figure 3:
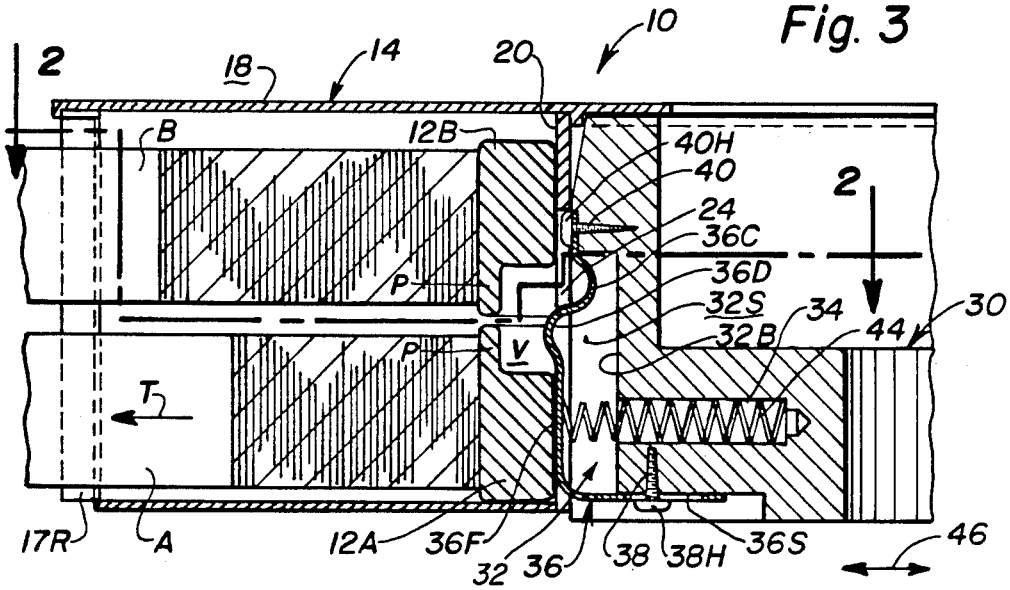
FIG. 3 is an enlarged side section view of the film dispensing apparatus taken along section lines 3—3 of FIG. 2.

With reference to FIGS. 1 through 3 shown are various views with appropriate portions broken away for clarity of a film dispensing apparatus generally indicated by reference character 10 able to support a pair of spools 12A, 12B of plastic film and to apply a rotation retarding force to one of the spools. The spools 12A, 12B each include a lateral projection P which are arranged in confronting relation to define an undercut volume V on the radially inner surface thereof. Each of the spools 12A, 12B carries a strip A and B, respectively, of a plastic film material, such as an ionomer resin film sold by E. I. du Pont de Nemours and Company, Inc. under the trademark Surlyn. The dispensing apparatus 10 includes a housing, or cannister, 14 comprised of a generally annular base portion 16 with a cylindrical sidewall 17. Since the dispensing apparatus 10 is to be used primarily in the environment of a chemical analysis instrument in which the strips A and B form transparent analysis cuvettes, the optical integrity of the strips must be maintained. To prevent exposing the strip material to dust, dirt, scratches, or any optically degrading conditions the cannister 14 is permanently closed by a cover 18.

Disposed on the interior of the cannister 14 is a central, axially extending hub 20. The hub 20 is provided with an axially extending tapered slot 24 for a purpose to be described. The outer peripheral surface 17 of the base portion 16 of the cannister 14 is provided with an exit slit 28 through which the strips A, B of plastic film supported by the spools 12A, 12B on the hub 20 may be drawn from the interior of the cannister 14. The sidewall 17 is provided with a radius 17R (FIG. 2) to prevent tearing or scratching of the strips A,B as they exit the cannister 14.

The hub 20 is sized so as to receive both of the spools such that, in the absence of further structure, both of the spools 12A, 12B would be able to freely rotate with respect to the hub 20. The hub 20 may be provided on the interior of the cannister 14 in any convenient fashion. Preferably, the hub 20 is integrally formed with the base portion 16 of the cannister 14. However, it remains within the contemplation of this invention to form the hub 20 in any other convenient manner so long as the spools 12A, 12B received within the cannister 14 are afforded a support for the rotational movement thereof.

The dispensing apparatus 10 further includes of spindle 30. The cannister 14 is mounted onto the spindle 30. The spindle 30 is slightly tapered throughout its entire length to correspond to the mold release taper of the inside of the hub 20. With more particular reference to FIGS. 2 and 3 the spindle 30 is shown as an elongated cylindrical member extensible into the interior of the hub 20. The spindle 30 has an axially extending groove 32 disposed on the exterior surface thereof. The groove 32 is defined by a pair of substantially parallel sidewalls 32S and a base 32B. It should be understood that in FIG. 1 the spindle 30 is shown rotated approximately one hundred eighty degrees about the axis X—X from the its location in the assembled dispensing apparatus in order to clearly present for view the groove 32 and the elements received therein. Communicating with the groove 32 is a bore 34 extending radially inwardly of the spindle 30.

Means for retarding the rotation of one of the spools 12A in the form of a clip 36 is mounted into the groove 30 by any convenient mounting arrangement, such as the mounting members, or screws, 38 and 40 (FIG. 3). The head 40H of the screw 40 projects slightly above the spindle 30. The clip 36 is a metallic member having an elongated friction producing surface 36F. The clip 36 is shaped to include a detent 36D which protrudes a predetermined distance above the surface of the spindle 30, both for a purpose to be discussed. A radially outwardly directed force is applied to the undersurface of the clip 36 to bias the surface 36F against the undersurface of the spool 12A by a compression spring 44 disposed in the bore 34. The clip 36 has a cutout slot 36S and is captured freely by the head 38H of the screw 38 to permit that end of the clip 36 to move toward or away from the spool 12A in the direction of the arrows 46, thus permitting the magnitude of the frictional force imposed by the clip 36 on the spool 12A to depend solely on the magnitude of the spring 44 and the coefficient of friction between the spool 12A and the surface 36F of the clip 36.

The clip 36 is contoured, as at 36C (FIG. 3) and extends into the groove 32. The clip 36 is thus confined within the groove 32 and abuts the sidewalls 32S as shown at 48. Abutment of the clip 36 with one or both of the sidewalls 32S of the groove 32 takes up any torque imposed on the clip 36 when the spool 12A is rotated on the hub 20 in response to a tensile force imposed on the tape A. In this manner any torque imposed on the clip 36 is transmitted into the spindle 30.

In operation, the free ends of each of the strips A, B of the film material carried on the spools 12A, 12B extend through the slit 28 defined in the sidewall 17 of the cannister 14. The spindle 30 may be conveniently supported at any appropriate location. The cannister 14 is mounted to the spindle 30 and located angularly with respect thereto by the receipt of the head 40H of the screw 40 in the top of the slot 24. This action appropriately angularly positions the cannister exit slot 28. The taper of the slot 24 serves as a lead-in for the head 40H of the screw 40. When the cannister 14 is properly received on the spindle 30 the spring loaded clip 36 is axially located with respect to the hub 20 such that the detent 36D protrudes through the slot 24 provided in the hub 20 and into the undercut volume V defined beneath the projections P on the spools 12A, 12B. This action locks the cannister 14 to the spindle 30. The friction producing surface 36F is thus placed into a friction generating relationship with the inner surface of the spool 12A that lies over the slot 24 of the hub 20. The friction generating interface between the surface 36F and the spool 12A extends substantially the full axial dimension of the spool 12A.

As a result, as the plastic material A is drawn from the spool 12A through the slot 2B by the imposition of a tensile force T on the end of the strip A of material carried on that spool 12A the friction producing surface 36F of the clip 36 generates a rotation retarding action on the spool 12A with which it is in contact. The spool 12A is thus inhibited from its free wheeling rotational action and is in fact loaded with a differential frictional force which inhibits the unreeling of the plastic material A on that spool 12A. The free wheeling action of the spool 12B is unaffected.

As a result of the rotation retarding member provided as described above the dispensation of the plastic material A on the spool 12A is inhibited. It should be appreciated that the invention may be realized by other alternative arrangements. For example the rotation retarding member may be disposed in the cannister in a location other than on the interior of the hub. The member may, for example, be mounted in a position between the cannister and the side of the selected spool whereby its rotation inhibiting action may be realized. Moreover, the inhibition of rotation of the selected spool may be realized by other than frictional interaction with the selected spool. A spring may be suitably mounted to the selected spool such that as the material is drawn therefrom an increasing force inhibiting the rotation of the spool may be generated.

Those skilled in the art, having the benefit of the teachings of the present invention as hereinabove set forth, may effect numerous modifications thereto. These and other modifications are to be construed as lying within the scope of the present invention as defined by the appended claims.

What is claimed is:

1. Apparatus for dispensing a strip of material mounted on each one of a pair of separate spools, the apparatus comprising:

a hub having an axial dimension sized to receive both of the spools in spaced axial adjacency, the hub having an axially extending slot therein, the slot being arranged in the hub so as to expose a portion of a selected one but not the other of the spools receivable thereon;

a spindle insertable into the hub, the spindle having a bore and a groove formed therein, the groove being defined by a pair of sidewalls and a base;

a rotation retarding member mounted within the groove in the spindle and projectable through the slot in the hub to abut the selected spool in a friction generating relationship so as to inhibit the rotation of the selected spool with respect to the hub, a portion of the member abutting against a sidewall of the groove and arranged so that any torque imposed on the member by rotation of the selected spool is transmitted to the spindle; and a biasing spring disposed in the bore, the spring biasing the member into the friction generating relationship with the spool.

2. Apparatus according to claim 1 wherein the rotation retarding member has an elongated friction generating surface thereon, the friction generating surface being sized to engage with the selected spool along an interface therebetween that extends substantially the full axial dimension of the spool so as to impose a frictional drag force on the selected spool.

3. The dispensing apparatus of claim 2 wherein the member is movable within the groove in directions toward or away from the spool.

4. The dispensing apparatus of claim 3 wherein the rotation retarding member has a detent thereon, the detent being engageable with the cannister thereby to hold the cannister to the spindle.

5. The dispensing apparatus of claim 2 wherein the rotation retarding member has a detent thereon, the detent being engageable with the cannister thereby to hold the cannister to the spindle.

* * * * *